US011820407B2

(12) United States Patent
Saxton et al.

(10) Patent No.: US 11,820,407 B2
(45) Date of Patent: Nov. 21, 2023

(54) COVERED HOPPER CAR

(71) Applicant: Gunderson LLC, Portland, OR (US)

(72) Inventors: Gregory J. Saxton, Portland, OR (US); Michael Gillis, Portland, OR (US)

(73) Assignee: Gunderson LLC, Portland, OR (US)

( * ) Notice: Subject to any disclaimer, the term of this patent is extended or adjusted under 35 U.S.C. 154(b) by 487 days.

(21) Appl. No.: 17/015,945

(22) Filed: Sep. 9, 2020

(65) Prior Publication Data

US 2020/0406938 A1 Dec. 31, 2020

Related U.S. Application Data

(63) Continuation-in-part of application No. 15/978,490, filed on May 14, 2018, now Pat. No. 10,807,615.

(60) Provisional application No. 62/506,990, filed on May 16, 2017.

(51) Int. Cl.

| | |
|---|---|
| ***B61D 17/08*** | (2006.01) |
| ***B61D 7/02*** | (2006.01) |
| ***B61D 17/06*** | (2006.01) |

(52) U.S. Cl.

CPC ..... *B61D 7/02* (2013.01); *B61D 17/06* (2013.01); *B61D 17/08* (2013.01)

(58) Field of Classification Search

CPC ..... B61D 7/02; B61D 17/06; B61D 17/08; B61D 7/00; B61D 17/00; B62D 25/02

See application file for complete search history.

(56) References Cited

U.S. PATENT DOCUMENTS

| | | | | |
|---|---|---|---|---|
| 949,838 | A * | 2/1910 | Pearson | B61D 17/12 52/56 |
| 1,383,841 | A * | 7/1921 | Oehm | B61D 17/12 52/47 |
| 2,079,862 | A | 5/1937 | Kiesel, Jr. | |
| 2,092,457 | A | 9/1937 | Kiesel, Jr. | |
| 3,040,679 | A | 6/1962 | Warntz | |
| 3,399,499 | A | 9/1968 | Stetz et al. | |
| 3,490,387 | A | 1/1970 | Halcomb | |
| 3,495,548 | A | 2/1970 | Rollins | |
| 3,509,827 | A | 5/1970 | Sutter | |
| 3,515,051 | A | 6/1970 | Pulcrano | |
| 3,538,857 | A | 11/1970 | Mowatt-Larsen | |
| 3,557,713 | A | 1/1971 | Spence et al. | |
| 3,570,592 | A | 3/1971 | Rollins | |
| 3,577,932 | A | 5/1971 | Pulcrano et al. | |
| 3,583,330 | A | 6/1971 | Freudman | |
| 3,583,331 | A | 6/1971 | Mowatt-Larssen | |
| 3,583,564 | A | 6/1971 | Rollins | |
| 3,675,591 | A | 7/1972 | Nagy et al. | |

(Continued)

FOREIGN PATENT DOCUMENTS

| | | |
|---|---|---|
| GB | 204490 | 10/1923 |

OTHER PUBLICATIONS

Office Action prepared by the US Patent and Trademark Office for U.S. Appl. No. 15/978,490, dated Apr. 14, 2020, 18 pages.

*Primary Examiner* — Mark T Le

(74) *Attorney, Agent, or Firm* — Chernoff, Vilhauer, Mcclung Stenzel, LLP

(57) ABSTRACT

A covered hopper railroad freight car having a car body whose opposite longitudinal sides include substantially flat, parallel, generally vertical upper side wall portions free from outwardly protruding structural strength members.

18 Claims, 9 Drawing Sheets

(56) References Cited

U.S. PATENT DOCUMENTS

| | | | | | |
|---|---|---|---|---|---|
| 3,789,773 | A * | 2/1974 | McNally | B61D 7/02 105/248 |
| 3,918,370 | A | 11/1975 | Campbell et al. | |
| 3,921,537 | A | 11/1975 | Fleshman et al. | |
| 4,003,319 | A | 1/1977 | Campbell et al. | |
| 4,168,665 | A | 9/1979 | Needham et al. | |
| 4,232,989 | A | 11/1980 | Miller | |
| 4,262,602 | A | 4/1981 | Patil et al. | |
| 4,292,898 | A | 10/1981 | Gordon et al. | |
| 4,334,481 | A | 6/1982 | Przbylinski et al. | |
| 4,352,331 | A | 10/1982 | Anderson et al. | |
| 4,362,111 | A | 12/1982 | Stark et al. | |
| 4,366,757 | A | 1/1983 | Funk | |
| 4,377,058 | A | 3/1983 | Hallam et al. | |
| 4,484,528 | A | 11/1984 | Anderson et al. | |
| 4,493,266 | A | 1/1985 | Augustine, Jr. | |
| 4,497,258 | A | 2/1985 | Ruhmann et al. | |
| 4,498,400 | A | 2/1985 | Vorwerk et al. | |
| 4,598,646 | A | 7/1986 | Dugge et al. | |
| 4,608,931 | A | 9/1986 | Ruhmann et al. | |
| 4,630,548 | A | 12/1986 | Wiger et al. | |
| 4,644,871 | A * | 2/1987 | Arrey | B61D 3/14 105/248 |
| 4,696,088 | A | 9/1987 | Miller | |
| 4,741,274 | A | 5/1988 | Ferris et al. | |
| 4,875,417 | A | 10/1989 | Coulborn et al. | |
| 4,884,511 | A | 12/1989 | Hallam et al. | |
| 4,893,568 | A | 1/1990 | Adams | |
| 4,898,101 | A | 2/1990 | Harter | |
| 4,922,833 | A | 5/1990 | Coulborn et al. | |
| 4,930,427 | A | 6/1990 | Ritter et al. | |
| 4,941,411 | A | 7/1990 | Wong | |
| 4,966,081 | A | 10/1990 | Dominguez et al. | |
| 5,144,895 | A | 9/1992 | Murray | |
| 5,159,882 | A | 11/1992 | Krug et al. | |
| 5,209,166 | A | 5/1993 | Tylisz et al. | |
| 5,259,322 | A | 11/1993 | Dominguez et al. | |
| 5,263,421 | A | 11/1993 | Lichty et al. | |
| 5,367,958 | A | 11/1994 | Weiss et al. | |
| 5,390,607 | A | 2/1995 | Lydic | |
| 5,762,003 | A | 6/1998 | Downes et al. | |
| 5,860,366 | A | 1/1999 | Lydic | |
| 5,934,200 | A | 8/1999 | Lydic | |
| 6,019,049 | A | 2/2000 | Gaydos et al. | |
| 6,044,771 | A | 4/2000 | Nguyen | |
| 6,067,912 | A | 5/2000 | Miller | |
| 6,119,345 | A | 9/2000 | Lydic et al. | |
| 6,302,031 | B1 | 1/2001 | Smith et al. | |
| 6,220,502 | B1 | 4/2001 | Gallinger et al. | |
| 6,237,505 | B1 * | 5/2001 | Sande | B61D 7/02 105/247 |
| 6,244,191 | B1 | 6/2001 | Lydic | |
| 6,276,058 | B1 | 8/2001 | Gallinger et al. | |
| 6,279,217 | B1 | 8/2001 | Gallinger et al. | |
| 6,279,487 | B1 | 8/2001 | Gaydos et al. | |
| 6,334,397 | B1 | 1/2002 | Valgora | |
| 6,502,518 | B1 | 1/2003 | Miller | |
| 6,604,469 | B1 | 8/2003 | Galvan et al. | |
| 8,622,004 | B2 | 1/2014 | Forbes et al. | |
| 10,807,615 | B2 * | 10/2020 | Gillis | B61D 17/06 |
| 2002/0157563 | A1 | 10/2002 | Richmond et al. | |
| 2004/0244638 | A1 | 12/2004 | Taylor | |
| 2005/0056185 | A1 | 3/2005 | Herzog et al. | |
| 2005/0056186 | A1 | 3/2005 | Creighton et al. | |
| 2008/0035014 | A1 * | 2/2008 | Gillis | B61F 1/02 105/248 |
| 2008/0127854 | A1 | 6/2008 | Forbes et al. | |
| 2009/0241799 | A1 | 10/2009 | Saxton et al. | |
| 2018/0127004 | A1 | 11/2018 | Gillis | |
| 2018/0334178 | A1 | 11/2018 | Gillis | |

* cited by examiner

COVERED HOPPER CAR

CROSS-REFERENCE TO RELATED APPLICATIONS

This application is a continuation-in-part (CIP) application of U.S. patent application Ser. No. 15/978,490, filed on May 14, 2018 and entitled COVERED HOPPER CAR, which claims the benefit of U.S. Provisional Patent Application Ser. No. 62/506,990, filed on May 16, 2017 and entitled COVERED HOPPER CAR. The complete disclosures of the above applications are hereby incorporated by reference for all purposes.

BACKGROUND OF THE INVENTION

The present application relates to railroad freight cars and, in particular, to a covered hopper car with increased volumetric capacity.

Covered railroad hopper car bodies have previously been constructed with flat sides reinforced by external side posts that extend laterally beyond the side sheets of the hoppers. An entire car, including such external side posts, is required not to extend into the space beyond the clearance limits for the railways on which such hopper cars are to be operated, and so the available volume of cars of that construction is limited by the space occupied by the external side posts.

Additionally, large flat panels welded to supporting beams may encounter "dimpling," slight buckling of the material, caused by weld shrinkage, which detracts from the desired appearance of a railroad freight car.

In order to provide for increased volumetric capacity other covered hopper cars have been constructed with curved sides, with longitudinal side plates that are convex on each side of the hopper car, curved about a longitudinal horizontal axis of curvature. The curvature of such side plates affords some stiffening of the car body without incorporating the weight of external side posts. Such cars, however, do include external beams, a side sill and a top chord, that are used to help provide sufficient strength and to permit convenient fabrication of such a car. While this design also provides additional volumetric capacity for such cars by comparison with cars equipped with external side posts, the curvature and the external beams result in reduced width of the hopper itself at the top of the car body and thus less than the maximum volumetric cargo capacity that could fit within the prescribed clearance window, limiting the external dimensions of the car.

What is desired, then, is an improved covered hopper car with adequate strength, yet with increased volumetric cargo capacity, while remaining within the prescribed size limitations imposed by the railroads where such a car is to be operated, and whose appearance is unaffected by distortions caused by weld shrinkage during construction of the car.

SUMMARY OF THE INVENTION

A covered hopper car as disclosed herein provides answers to some of the previously-mentioned shortcomings of previously known hopper cars.

In one embodiment, the hopper car disclosed herein includes sides having upper side sheet portions that are substantially flat.

In one embodiment of the hopper car disclosed herein, the substantially flat upper portions of the sides of such a hopper car may be supported by one or more internal stiffeners and/or one or more strengthening members.

In one embodiment of the hopper car disclosed herein, the top margin of each substantially flat side sheet may include a bend that both provides some stiffening along the top of the side portions of the hopper car and provides a member to which a roof sheet for the car can be attached.

In one embodiment of the hopper car disclosed herein, an internal side plate may extend along the length of the top margin of each of the side portions and may be oriented at an inwardly-sloped attitude, so as to bridge a space between a substantially vertical portion of a side sheet and an underside of a roof sheet of the hopper car so as to provide stiffening and support for the top margins of the side sheets.

In one embodiment of the hopper car disclosed herein longitudinally-extending corrugations may be provided to function as stiffeners at an intermediate height within the substantially flat upper portions of the sides of the hopper car, while lower portions of the sides of the hopper car may incorporate a curved configuration.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
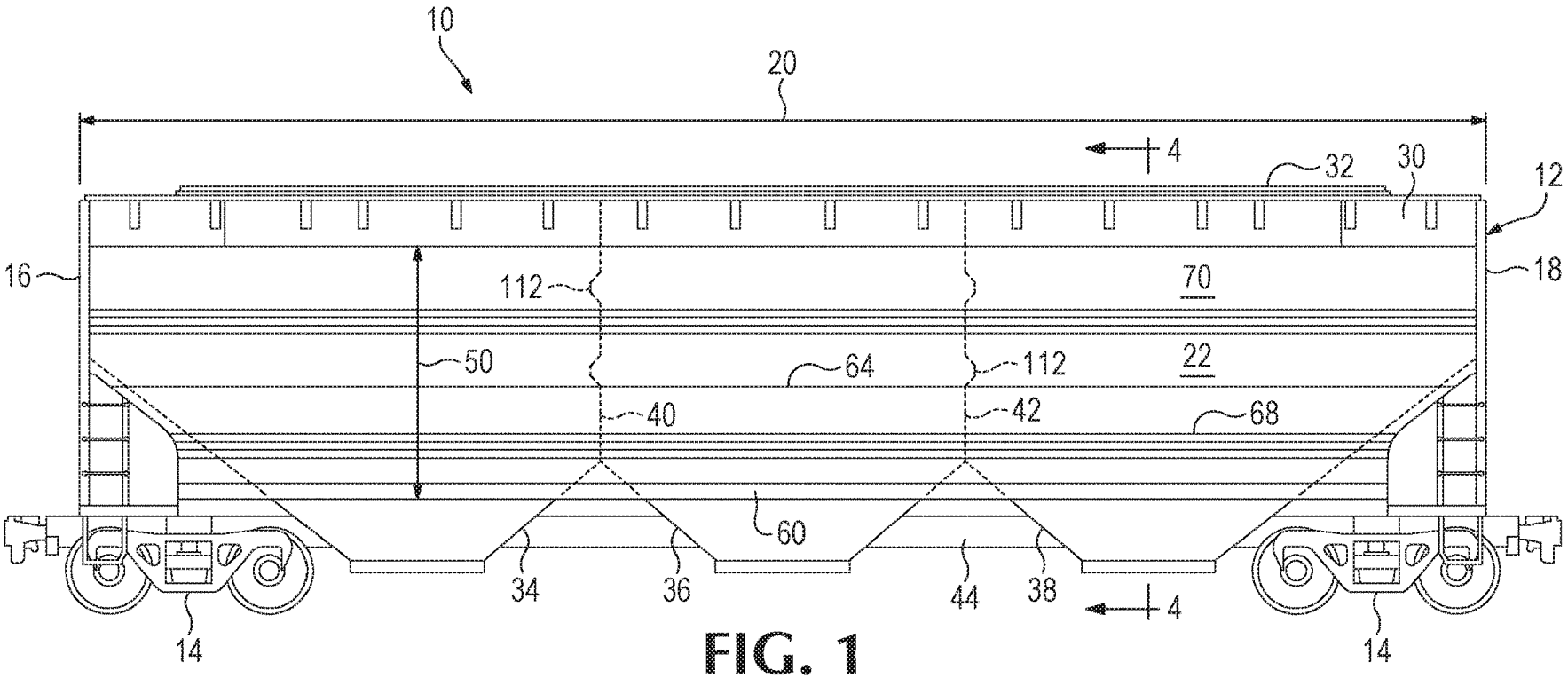
FIG. 1 is a side elevational view of an example of a covered hopper type railroad freight car including side walls having substantially flat upper portions of the present disclosure.
Figure 2:
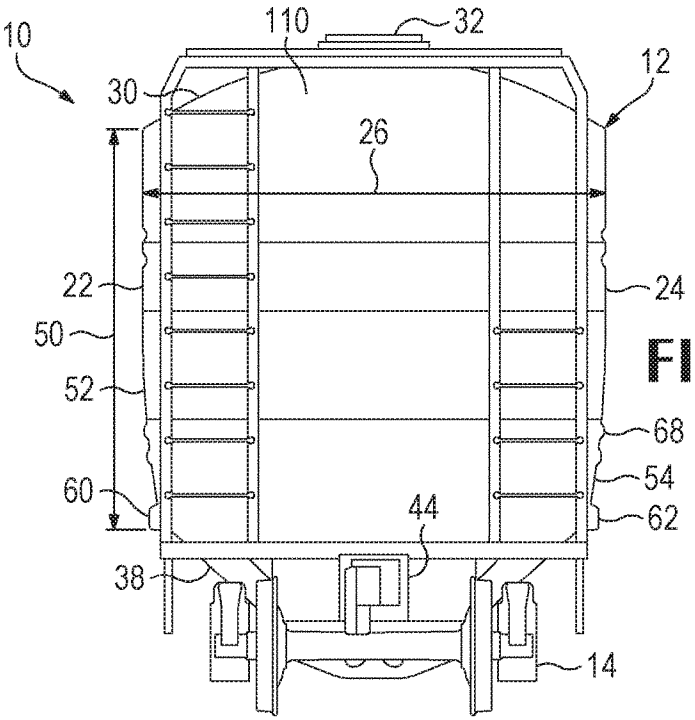
FIG. 2 is an end elevational view of the covered hopper railroad freight car shown in FIG. 1.
Figure 3:
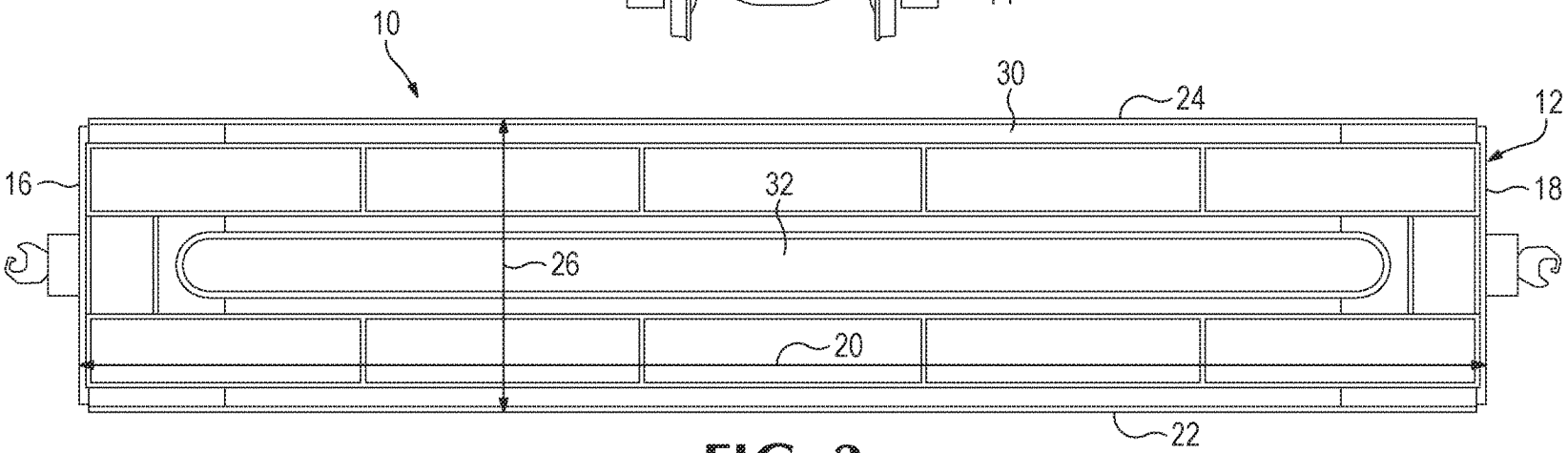
FIG. 3 is a top plan view of the covered hopper railroad freight car shown in FIGS. 1 and 2.

Referring now to the drawings that form a portion of the disclosure herein, FIGS. 1 through 3 show a railroad freight car 10 of the covered hopper type incorporating a novel construction providing an increased volumetric capacity by comparison with previously known covered hopper cars. Unless explicitly excluded, covered hopper car 10 may include one or more components of other covered hopper cars of the present disclosure.

The covered hopper car 10 includes a car body 12 carried on a pair of wheeled trucks 14 and having a pair of opposite ends 16 and 18 defining a length 20. A pair of opposite sides 22 and 24 define a width 26. A roof 30 is attached to and supported by the ends 16 and 18 and the sides 22 and 24 and may include a centrally-located, longitudinally-extending hatch 32 providing access to, for example, three separate cargo hoppers 34, 36, and 38 defined within the car body 12.

A pair of transversely-extending bulkheads 40 and 42 extend between the sides 22 and 24, separating the cargo hoppers 34, 36, and 38 from each other.

A center sill 44 may extend through the entire length of the car body, and an appropriate protective structure 46 may extend along the top of the center sill 44 within each hopper to assure that cargo is free to slide out of each hopper, rather than being able to remain atop the center sill 44 when the hopper is emptied.

Each of the opposite sides 22 and 24 of the car body 12 has a height 50 of, for example, 112½ inches, above the hoppers and has a respective lower side portion 52, 54 that is convexly curved, with a long radius of curvature about an axis of curvature (not shown) extending longitudinally of the car body 12. The lower margin 56 of each of the lower portions 52, 54 may be joined, as by welding, to an upper margin of a respective side slope sheet of each of the hoppers 34, 36, and 38 of the car body 12. A tubular reinforcing member or bottom chord 60, 62 may extend horizontally along an outer side of each of the lower side portions 52, 54, at about the height of the upper margins 56 of the side slope sheets, on each side of the car body 12.

Upper margins 64 of the lower portions 52, 54 of the sides 22 and 24 are spaced further apart laterally with respect to the car body 12 than are the lower margins 56, and longitudinally-extending horizontal reinforcing corrugations 68 may be provided near the upper margins 64. The reinforcing corrugations 68 may be formed integrally in the metal of the lower portions 52, 54 as a part of the process of forming the lower portions of the sides 22 and 24, and may each have a width 67 of about 2¾ inches and may protrude outwardly a distance 66 of about ½ inch with respect to the lower portions of the sides, and may be separated by a distance 65 of about 2 inches. The lower portions 52 and 54 may have a height 69 of 50½ inches, and may be of sheet steel of about 7 gauge thickness, for example.

Joined to the upper margins 64 of the lower portions 52, 54 of the sides 20 and 22, as by appropriate weld joints, are respective substantially planar upper side wall portions 70 and 72 of the sides 20 and 22, extending substantially vertically upward and parallel with each other, over a height 74 of 62 inches, for example, that is greater than the height 69. The upper side wall portions 70 and 72 may be of sheet steel having a thickness 74 of about 7 gauge for example. The upper side wall portions of the car body 12 may be spaced apart from each other by an appropriate distance resulting in the overall width 26 of the car 10 approaching, but not exceeding, the maximum width permitted by the applicable clearance window associated with the railroad track lines over which the car 10 may be expected to be operated. Since the upper sidewall portions 70 and 72 of the sides 20 and 22 are generally planar, vertical, and parallel with each other a maximum amount of cargo space can be provided between them, while the car body overall is not too wide to remain within the clearance envelope appropriate for the hopper car 10. The absence of support posts on the exterior faces of the side walls of the covered hopper car 10 leaves a long, generally flat, exterior shape for the sides 20 and 22 of the hopper car body 12, with few or no dimples caused by weld shrinkage to deteriorate from the generally pleasing appearance of the hopper car body 12.

As may be seen best in FIG. 3, the roof 30 covers the entire hopper car body includes the centrally-located, longitudinally-extending hatch 32 for receiving bulk cargo such as grain, and a hatch cover of appropriate design may also be provided.

Figure 4:
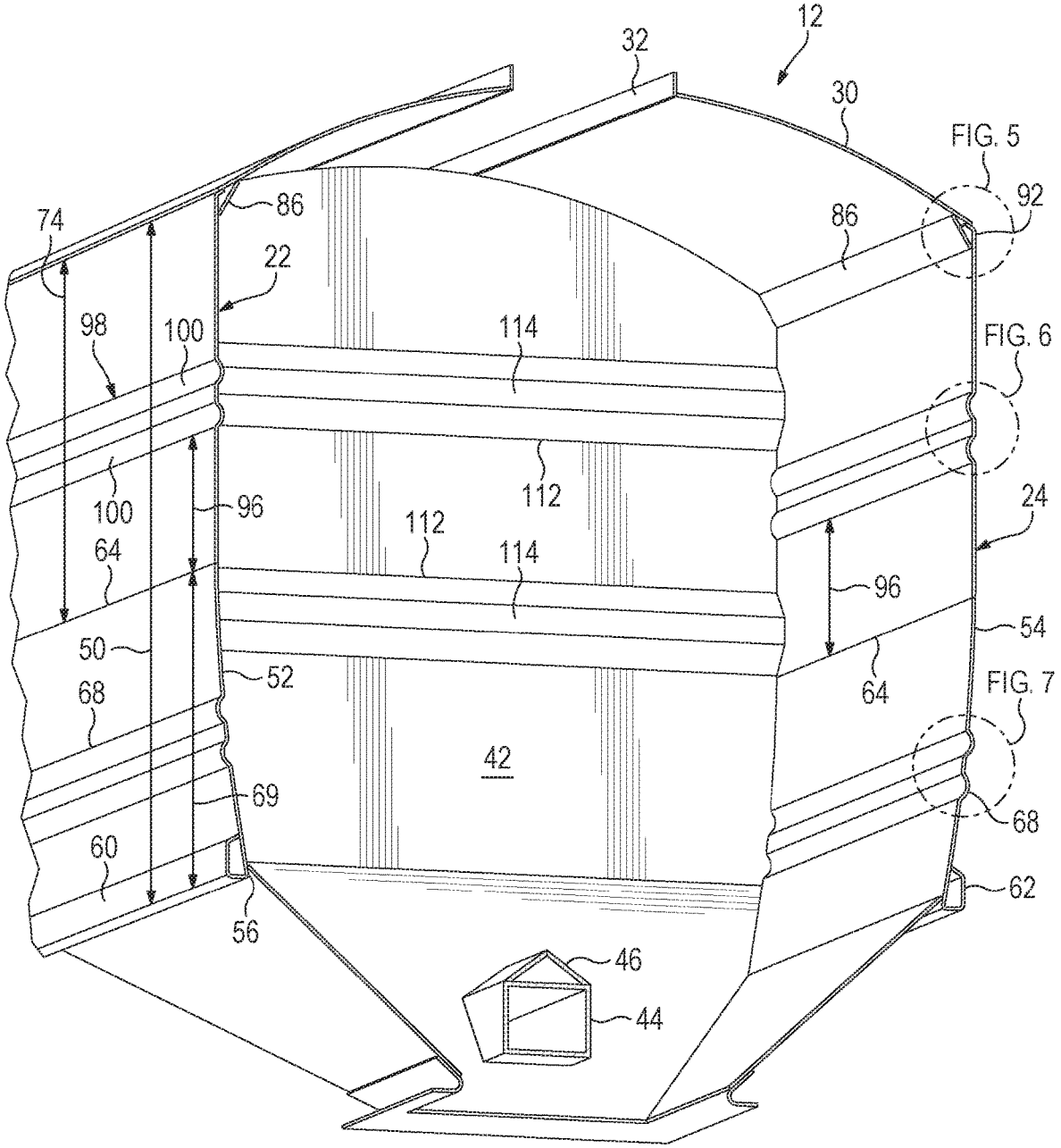
FIG. 4 is an isometric view, taken along line 4-4 of FIG. 1, at an enlarged scale, showing a portion of the car body including the structure of the sidewalls, a bulkhead, and past of a hopper included in the car body, as well as the manner of interconnection of the side walls with the roof of the car body.
Figure 5:
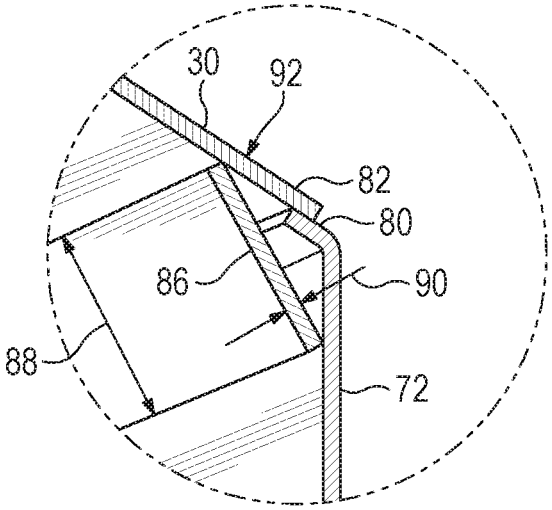
FIG. 5 is a detail view, showing a portion of FIG. 4 at an enlarged scale, including the interconnection of a side wall with the roof and the configuration of a stiffening portion of the side wall member of the car body.

As shown in FIGS. 4 and 5, a narrow portion of each upper side wall portion 70 and 72 may be bent inward along a horizontal line to provide an inwardly and upwardly inclined flange portion 80. A lower, laterally outward margin 82 of a base sheet of the upwardly arched roof 30 of the car body 12 may overlap the flange by a small distance, such as about one-half inch. The outward margin 82 of the roof is securely attached to the flange portion 80, as by welding. Additionally, a reinforcing side plate 86, having a width 88 of 4¾ inches, for example, and which may be of sheet metal material whose thickness 90 is about 0.18 inch (7 gauge), for example, thus of similar thickness to the side wall portions 70 and 72 and the base sheet of the roof 30, forming a triangular tubular top chord structure 92 extending along the junction between the upper side wall flange portions 80 and the roof 30. One or more other covered hopper cars of the present disclosure may include the same or similar connection provided by flange portion 80, margin 82, and reinforcing side plate 86 as described above.

Figure 6:
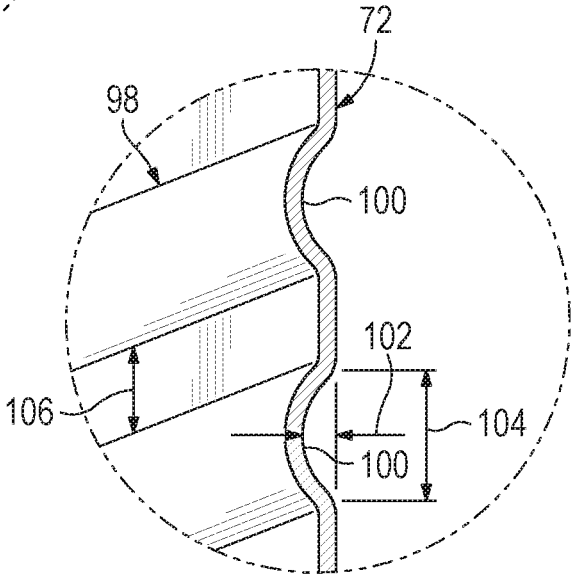
FIG. 6 is a detail view, showing a portion of FIG. 4 at an enlarged scale, including a stiffener portion of a lower part of a side wall member of the car body.
Figure 7:
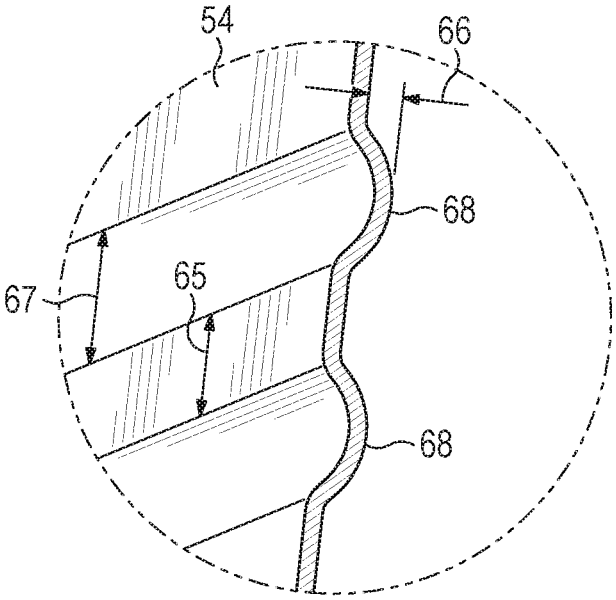
FIG. 7 is a detail view, showing a portion of FIG. 4 at an enlarged scale, including a stiffener portion of a bulkhead extending between the side walls of the car and dividing it into separate hopper portions.
Figure 8:
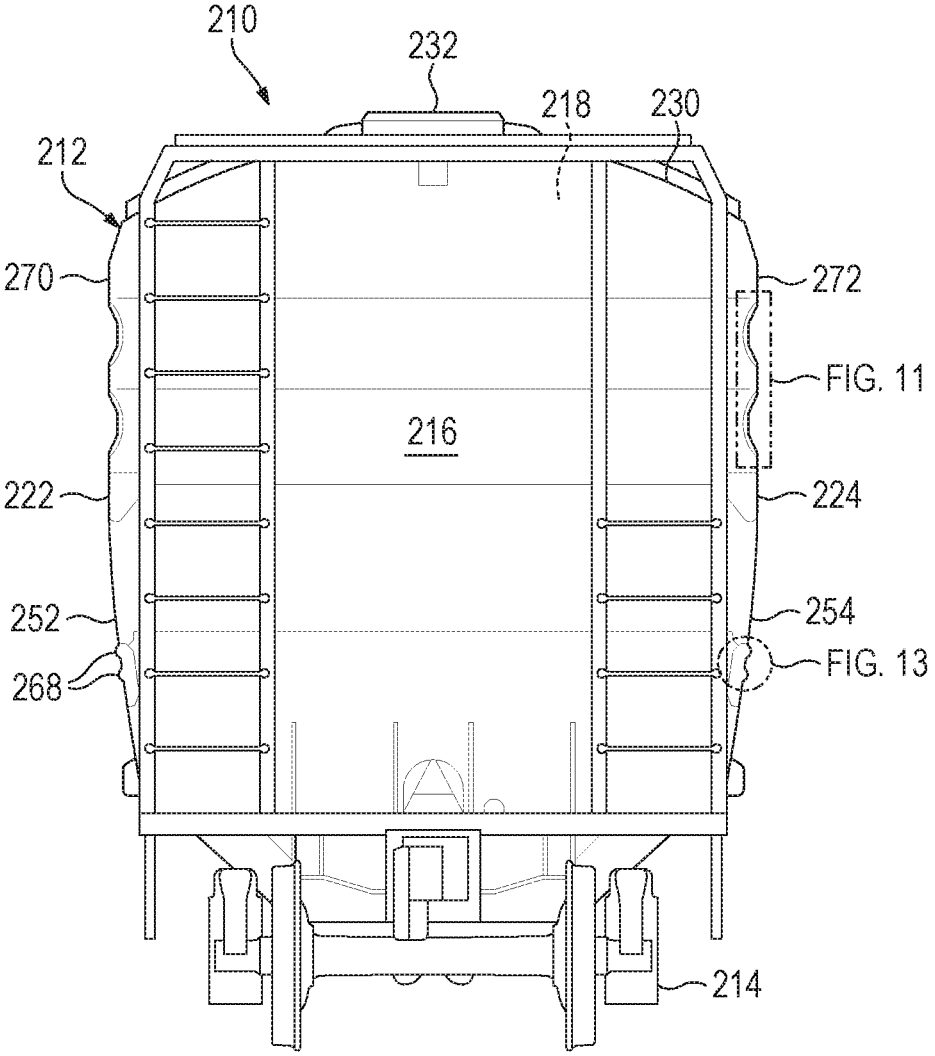
FIG. 8 is an end elevational view of another example of a covered hopper type railroad freight car including side walls having substantially flat upper portions of the present disclosure.
Figure 9:
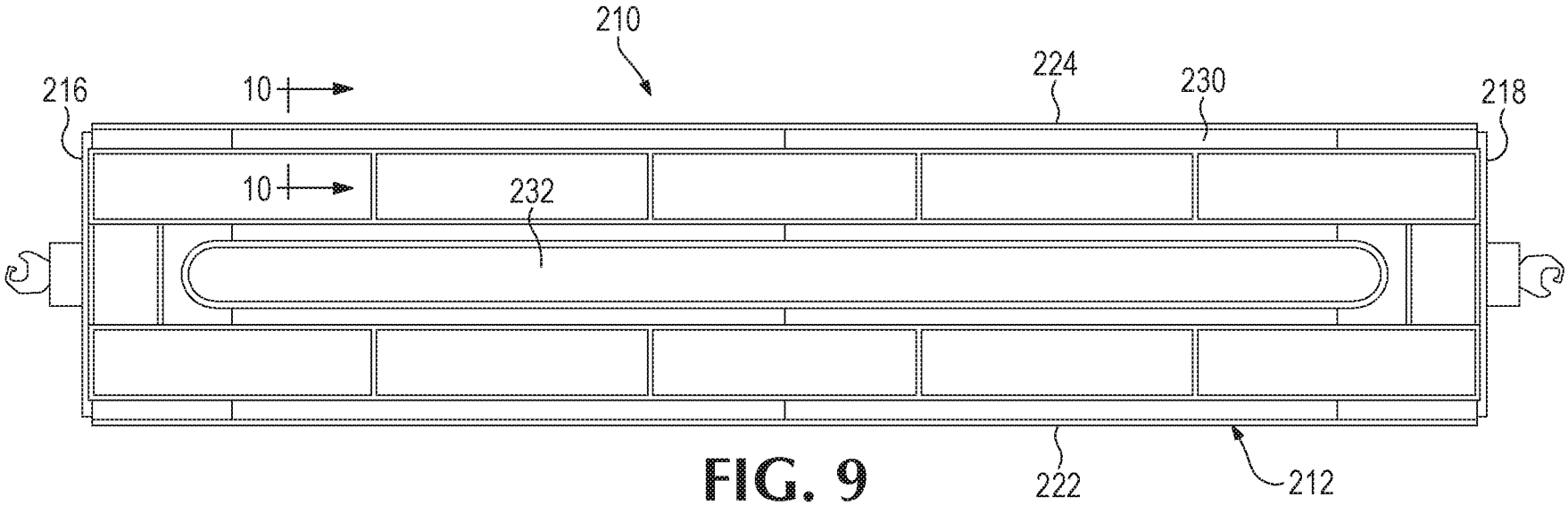
FIG. 9 is a top plan view of the covered hopper railroad freight car shown in FIG. 8.
Figure 10:
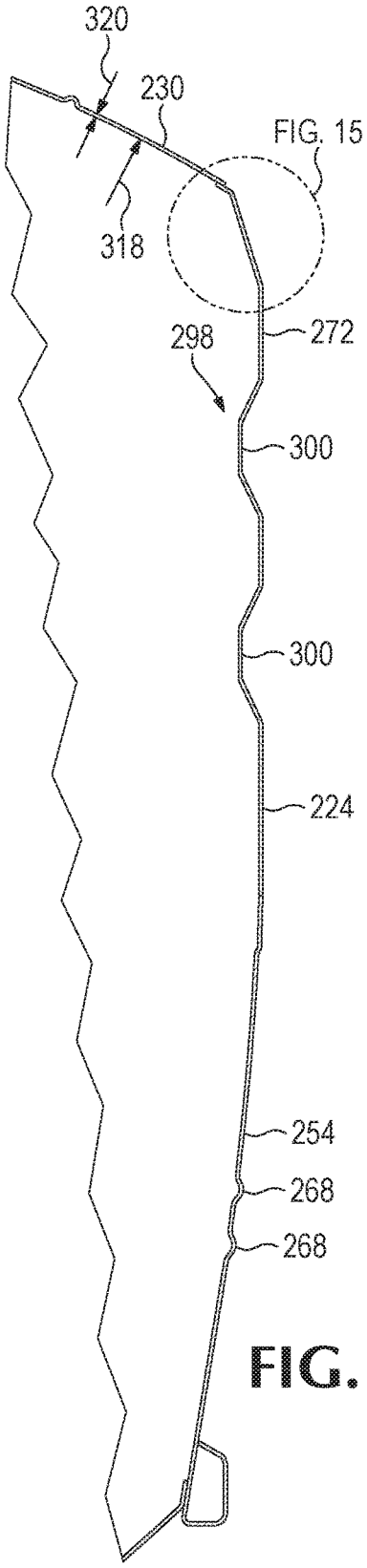
FIG. 10 is a partial sectional view of the covered hopper railroad freight car of FIG. 8 taken along lines 10-10 in FIG. 9.

At a distance 96 of, for example, 22¼ inches above the joints between the upper margin 64 of the lower portions 52, 54 and the lower margins of the upper side wall portions 70 and 72, a longitudinally-extending stiffener 98 may be provided in each of the upper side wall portions. The stiffener 98 may have the form of, for example, a pair of parallel channels 100 that may be formed, as by rolling, in the metal plate material of each of the upper side wall portions 70 and 72. As may be seen in greater detail in FIG. 6, the channels 100 may each have a depth of 102 of 1 1/16 inch and a width 104 of 5 inches measured in a vertical direction along the upper side wall portion 70 or 72, and the channels 100 may be spaced apart from each other by a distance 106 of about 2 inches. While the stiffener 98 might be formed as a separate piece that could be welded into place between respective upper and lower panels (not shown) of the upper sidewall portions, it is expected that the stiffener 98 will be formed in the sheet metal of each upper side wall portion 70 or 72 as by rolling the metal plate material prior to cutting it to its final shape for use as an upper side wall portion 70 or 72 of the car body 12. The channels 100 may be formed so that they protrude inwardly, rather than bulging outwardly beyond the plane of the upper side wall portions 70 and 72.

At each of the ends 16 and 18 a substantially vertical and generally flat end plate 110 extends upward from the respective slope sheet of the cargo hopper 34 or 38 defined by that end of the car body 12. Each end plate 110 is securely attached, as by welding, to the inner side of each of the adjacent upper side wall portions 70 and 72 and to the underside of the roof 30, to complete a closed end of the respective cargo hopper 34 or 38.

At respective positions along the length of the car body 12 the bulkheads 40 and 42 extend upward, from the upper margins of the slope sheets of the hoppers to the roof 30. Each bulkhead 40 or 42 extends transversely of the car body 12 and is securely attached, as by being welded, to the hopper slope sheets and the interior side of each of the lower side portions 52 and 54, the upper side wall portions 70 and 72, and the roof 30. Rather than being merely a flat plate, each bulkhead 40 and 42 may be stiffened by at least one transversely-extending horizontal stiffener 112. Such a stiffener may be of a trapezoidal shape such as incorporating a pair of sloped portions each connected to an offset portion 114 extending vertically, parallel with, but longitudinally spaced a small distance apart from the main plane of the particular bulkhead, as may be seen best in FIG. 1. It will be appreciated that the bulkhead stiffeners 112 may be of other designs, such as including curved corrugations, so long as they provide appropriate rigidity of the bulkheads 40 and 42 and provide some support for the flat, vertical, upper side wall portions 70 and 72.

Referring to FIGS. 8-15, another example of covered hopper car 10 is shown, which is generally indicated at 210. Unless explicitly excluded, covered hopper car 210 may include one or more components of the other covered hopper cars of the present disclosure. Covered hopper car 210 includes a car body 212 carried on a pair of wheeled trucks 214. The car body 212 includes a pair of opposite ends 216 and 218 and a pair of opposite sides 222 and 224. A roof 230 is attached to and supported by the ends 216 and 218 and the sides 222 and 224. Each of the opposite sides 222 and 224 of the car body 212 has a respective lower side portion 252, 254 that is convexly curved, with a long radius of curvature about an axis of curvature (not shown) extending longitudinally of the car body 212. Additionally, each of the opposite sides 222 and 224 of the car body 212 include substantially planar (or flat) upper side wall portions 270 and 272, extending substantially vertically upward and parallel with each other. The lower side portions and upper side wall portions may be joined to other components as described for covered hopper car 10.

Figure 14:
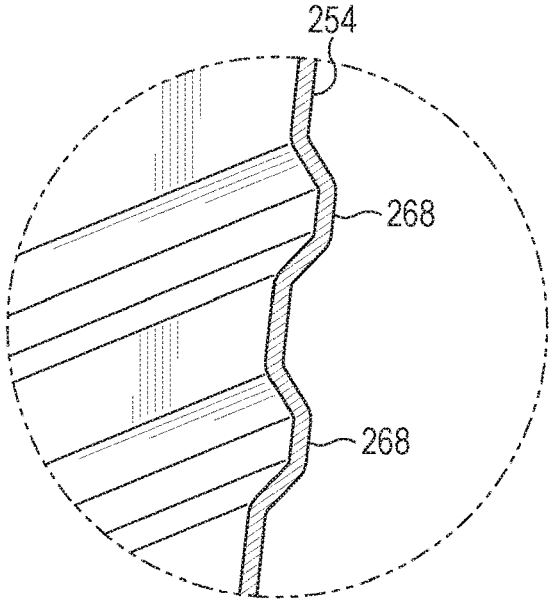
FIG. 14 is a detail view, showing a portion of FIG. 8 at an enlarged scale, including another example of a stiffener portion of a bulkhead extending between the side walls of the car and dividing it into separate hopper portions.

Similar to covered hopper car 10, lower side portions 252 and 254 may include longitudinally-extending horizontal reinforcing corrugations 268 (such as near upper margins of the lower side portions). Similar to corrugations 68 of covered hopper car 10, corrugations 268 protrude outwardly, as shown in FIG. 14. However, unlike corrugations 68, corrugations 268 may have a rectilinear shape (e.g., trapezoidal). Alternatively, corrugations 268 may be the same or similar curvilinear shape as corrugations 68. The dimensions and spacing of corrugations 268 may be similar to the dimensions of corrugations 68 as described above.

Figure 11:
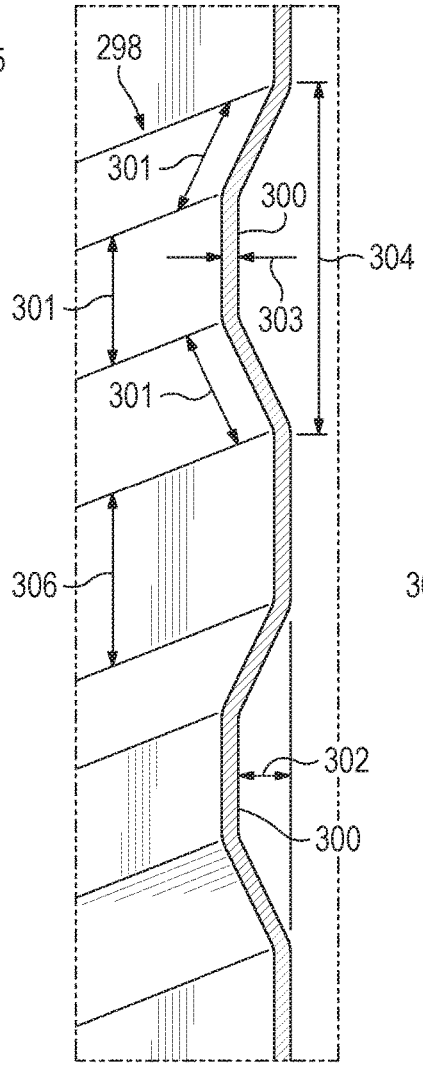
FIG. 11 is a detail view, showing a portion of FIG. 8 at an enlarged scale, including an example of a stiffener portion of a lower part of a side wall member of the car body.
Figure 12:
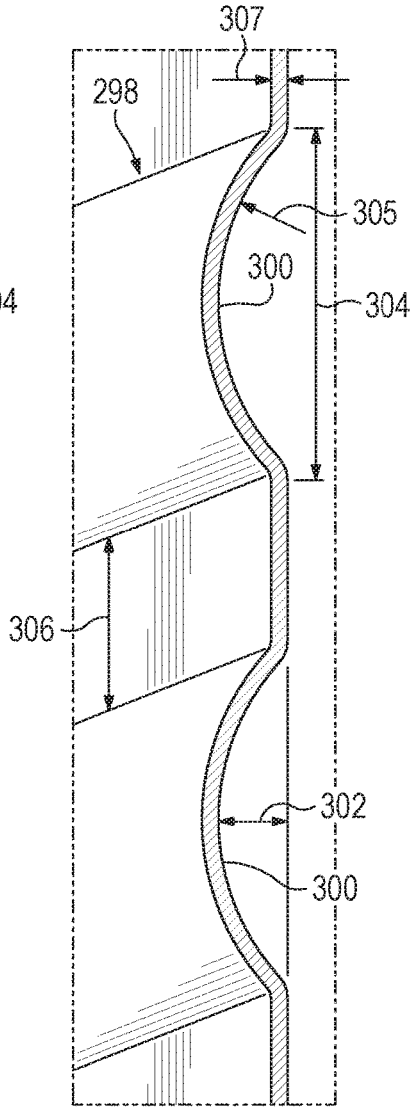
FIG. 12 is a detail view, showing a portion of FIG. 8 at an enlarged scale, including another example of a stiffener portion of a lower part of a side wall member of the car body.

Similar to covered hopper car 10, upper side wall portions 270 and 272 may include longitudinally-extending stiffeners 298 in the form of a pair of parallel channels 300 that may be formed, as by rolling, in the metal plate material of each of the upper side wall portions 270 and 272. However, channels 300 are much larger than channels 100 (e.g., two, three, or four times larger), which is particularly significant to limit distortions caused by weld shrinkage to maximize the internal volume of the hoppers of the covered hopper car 200. For example, the channels 300 may each have a depth 302 of about 1¾ to about 2¼ inches and a width 304 of about 11 13/16 to about 17¼ inches measured in a vertical direction along the upper side wall portion 270 or 272, and the channels 300 may be spaced apart from each other by a distance 306 of about 5¾ inches, as shown in FIG. 11. Additionally, the channels may have a width 301 over thickness 303 (b/t) ratio not to exceed 70. Moreover, channels 300 are rectilinear (e.g., trapezoidal) in shape compared to channels 100 that are curvilinear in shape. Alternatively, channels 300 may be curvilinear in shape similar to channels 100 with a radius 305 over thickness 307 ratio (r/t) not to exceed 500, as shown in FIG. 12.

Stiffeners 298 may be formed in the sheet metal of each upper side wall portion 270 or 272 as by rolling the metal plate material prior to cutting it to its final shape for use as an upper side wall portion 270 or 272 of the car body 212 (or by forming the bends on a press brake). Alternatively, the stiffeners 298 may be formed as a separate piece that could be welded into place between respective upper and lower panels (not shown) of the upper sidewall portions. Channels 300 may be formed so that they protrude inwardly, rather than bulging outwardly beyond the plane of the upper side wall portions 270 and 272, which is particularly significant in maximizing the internal volume of the hoppers of the covered hopper car 200.

Figure 15:
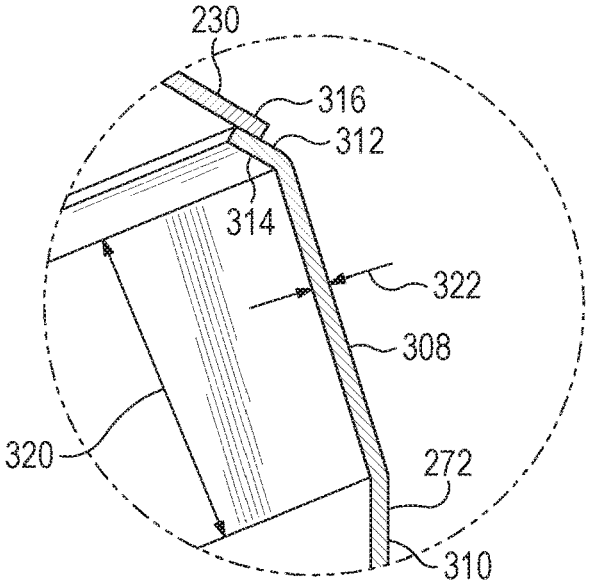
FIG. 15 is a detail view, showing a portion of FIG. 10 at an enlarged scale, including the interconnection of a side wall with the roof.

As shown in FIG. 15, an upper portion of each upper side wall portion 270 and 272 may include (1) an inclined part 308 bent inward from a generally vertical part 310 along a horizontal line and (2) an upper portion or margin 312 that is further bent inward from the inclined part along a horizontal line to provide an inwardly and upwardly inclined flange portion 314. A lower, laterally outward margin 316 of a base sheet of the upwardly arched roof 230 of the car body 212 may overlap the flange by a small distance, such as about one-half inch. The outward margin 316 of the roof is securely attached to the flange portion 314, as by welding. As shown in FIG. 15, there is no reinforcing side plate or other reinforcing structure attached to, or formed with, the junction between the upper side wall flange portions 314 and the roof 230, which maximizes the internal volume of the hoppers of covered hopper car 210. In some examples, the radius 318 over thickness 320 (r/t) ratio of roof 230 does not exceed 750, and the width 320 over thickness 322 (b/t) ratio of inclined part 308 does not exceed 60.

Figure 16:
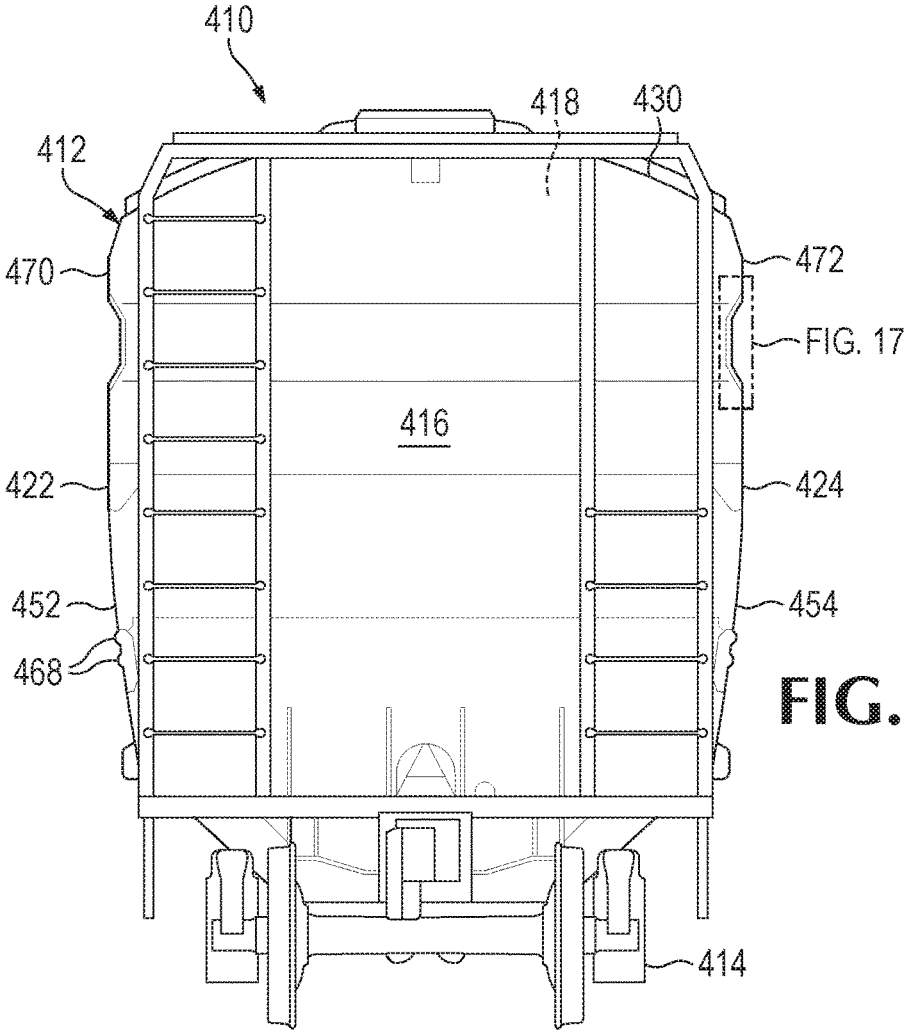
FIG. 16 is an end elevational view of a further example of a covered hopper type railroad freight car including side walls having substantially flat upper portions of the present disclosure.
Figure 17:
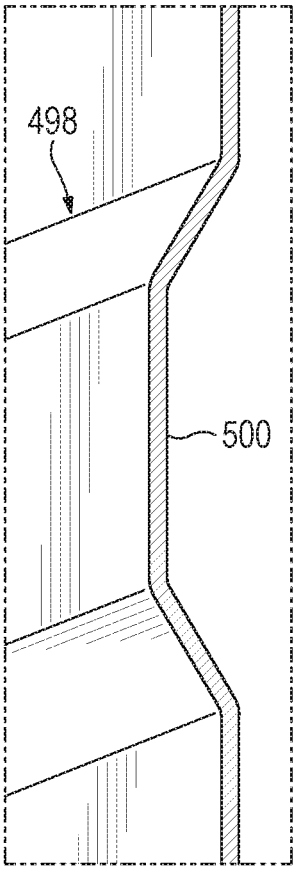
FIG. 17 is a detail view, showing a portion of FIG. 16 at an enlarged scale, including an example of a stiffener portion of a lower part of a side wall member of the car body.
Figure 18:
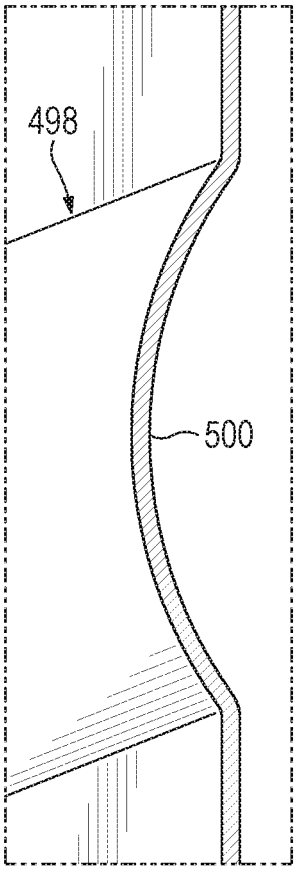
FIG. 18 is a detail view, showing a portion of FIG. 16 at an enlarged scale, including another example of a stiffener portion of a lower part of a side wall member of the car body.

Referring to FIGS. 16-18, another example of covered hopper car 10 is shown, which is generally indicated at 410. Unless explicitly excluded, covered hopper car 410 may include one or more components of the other covered hopper cars of the present disclosure. Covered hopper car 410 includes a car body 412 carried on a pair of wheeled trucks 414. The car body 412 includes a pair of opposite ends 416 and 418 and a pair of opposite sides 422 and 424. A roof 430 is attached to and supported by the ends 416 and 418 and the sides 422 and 424. Each of the opposite sides 422 and 424 of the car body 212 has a respective lower side portion 452, 454 that is convexly curved, with a long radius of curvature about an axis of curvature (not shown) extending longitudinally of the car body 412. Additionally, each of the opposite sides 422 and 424 of the car body 412 include substantially planar (or flat) upper side wall portions 470 and 472, extending substantially vertically upward and parallel with each other. The lower side portions and upper side wall portions may be joined to other components as described for covered hopper car 10.

Figure 13:
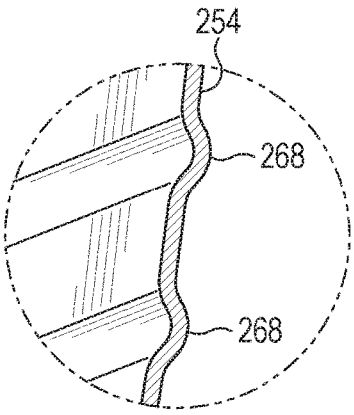
FIG. 13 is a detail view, showing a portion of FIG. 8 at an enlarged scale, including an example of a stiffener portion of a bulkhead extending between the side walls of the car and dividing it into separate hopper portions.

Unlike covered hopper car 210, upper side wall portions 470 and 472 each include only a single longitudinally-extending stiffener 498 in the form of a single channel 500 that may be formed, as by rolling, in the metal plate material of each of the upper side wall portions 470 and 472. Additionally, channel 500 is rectilinear (e.g., trapezoidal) in shape, as shown in FIG. 13. Alternatively, channel 500 may be curvilinear in shape similar to channels 100, as shown in FIG. 14. Stiffeners 498 may be formed as described above for stiffeners 298. In some examples, channels 500 may have the same or similar dimensions, radius/thickness ratios, and/or width/over thickness ratios as channels 300. Covered hopper cars 210 and 410 may include other components and/or structures of covered hopper car 10. For example, covered hopper cars 210 and/or 410 may include the interconnection components of side wall with the roof shown in FIG. 5 and described above instead of the interconnection components shown in FIG. 15.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A car body for a covered hopper railroad freight car, the car body comprising: a pair of opposite sides and a pair of opposite ends defining a width, a height, and a length, the car body including a plurality of cargo hoppers between the opposite sides, and each of the opposite sides extending over a majority of a height of the car body and including a substantially flat, generally vertical upper side wall portion defining a plane, wherein each of the upper side wall portions includes at least one longitudinally extending stiffener member formed therein, each longitudinally extending stiffener member includes a channel that protrudes inwardly of the plane, wherein the car body further comprises a roof extending along a length of the car body and extending transversely from one to the other of the opposite sides, the roof being attached to a planar upper margin of each of the opposite upper side wall portions, the planar upper margin is bent inwardly to provide an inwardly and upwardly inclined flange portion, wherein each of the upper side wall portions includes a generally vertical part, the planar upper margin, and a planar inclined part disposed between the generally vertical part and the planar upper margin, the planar inclined part being bent inwardly relative to the generally vertical part, and the planar upper margin being bent inwardly relative to the planar inclined part.

2. The car body of claim 1, wherein the width/thickness ratio of the inclined part does not exceed 60.

3. The car body of claim 2, wherein the radius/thickness ratio of the roof does not exceed 750.

4. The car body of claim 1, wherein the opposite sides include convexly curved lower side portions and each lower side portion includes a bottom chord protruding laterally outward and extending along a bottom margin of each lower side portion.

5. The car body of claim 1, wherein the at least one longitudinally extending stiffener member of each upper side wall portion includes two longitudinally extending stiffener members each having a channel that protrudes inwardly of the plane.

6. The car body of claim 5, wherein the two longitudinally extending stiffener members include first and second channels each having a curvilinear cross-sectional shape.

7. The car body of claim 6, wherein the radius/thickness ratio of each of the first and second channels does not exceed 500.

8. The car body of claim 5, wherein the two longitudinally extending stiffener members include first and second channels each having a rectilinear cross-sectional shape.

9. The car body of claim 8, wherein the rectilinear cross-sectional shape is a cross-sectional shape of a trapezoid.

10. The car body of claim 8, wherein the width/thickness ratio of each of the first and second channels does not exceed 70.

11. The car body of claim 1, wherein the at least one longitudinally extending stiffener member includes at least one channel having a curvilinear cross-sectional shape.

12. The car body of claim 11, wherein the radius/thickness ratio of the at least one channel does not exceed 500.

13. The car body of claim 1, wherein the at least one longitudinally extending stiffener member includes at least one channel having a rectilinear cross-sectional shape.

14. The car body of claim 13, wherein the rectilinear cross-sectional shape is a cross-sectional shape of a trapezoid.

15. The car body of claim 13, wherein the width/thickness ratio of the at least one channel does not exceed 70.

16. The car body of claim 1, wherein each of the opposite sides includes a lower side portion that includes at least one longitudinally extending stiffener portion formed therein.

17. The car body of claim 1, wherein the roof and the upper margin are free from one or more reinforcing structures at junctions formed by the roof and the planar upper margins.

18. The car body of claim 1, wherein each of the upper side wall portions includes only one of the longitudinally extending stiffener member formed therein.

* * * * *